United States Patent [19]

Saito et al.

[11] Patent Number: 4,759,399

[45] Date of Patent: Jul. 26, 1988

[54] METHOD AND APPARATUS FOR PRODUCING HOLLOW METAL INGOTS

[75] Inventors: Kenji Saito; Yukio Oguchi, both of Chiba; Toshio Kato, Kurashiki; Hideshi Ohzu, Kurashiki; Kanji Aizawa, Kurashiki; Minoru Yao, Kurashiki, all of Japan

[73] Assignee: Kawasaki Steel Corporation, Kobe, Japan

[21] Appl. No.: 47,625

[22] Filed: May 7, 1987

[30] Foreign Application Priority Data

May 15, 1986 [JP] Japan ..... 61-111196
Jun. 18, 1986 [JP] Japan ..... 61-140279

[51] Int. Cl.[4] ..... B22D 7/04; B22D 27/04

[52] U.S. Cl. ..... 164/126; 164/125; 164/348; 164/369

[58] Field of Search ..... 164/126, 125, 127, 128, 164/348, 369

[56] References Cited

U.S. PATENT DOCUMENTS 4,278,124 7/1981 Aso et al. ..... 164/125
4,615,373 10/1986 Saito et al. ..... 164/125

FOREIGN PATENT DOCUMENTS 0092477 10/1983 European Pat. Off. ..... 164/127
50-28898 9/1975 Japan ..... 164/348
59-197346 11/1984 Japan ..... 164/127
954151 8/1982 U.S.S.R. ..... 164/127

*Primary Examiner*—Nicholas P. Godici
*Assistant Examiner*—J. Reed Batten, Jr.
*Attorney, Agent, or Firm*—Balogh, Osann, Kramer, Dvorak, Genova & Traub

[57] ABSTRACT

Hollow metal ingots are produced by a hollow metal manufacturing apparatus comprising a mold placed on a stool, and a cylindrical metallic cooling core placed in the mold to form an annular casting space therebetween. During the casting, a cooling fluid is directly blown upon the inner surface of the core while the cylindrical metallic core is allowed to be buckled. The cooling core is constituted by an outermost metallic cylinder to be brought into contact with a molten metal, a cylindrical lattice-fashioned buckling-adjusting frame positioned in the metallic cylinder and provides passages through which the cooling fluid is passed, and a cooling fluid vessel which is positioned inside the buckling-adjusting frame and is provided with a number of cooling fluid blowing nozzles.

3 Claims, 4 Drawing Sheets

11
12
33
39
4
G
G
39
7
10
10
6
8
6
7a
39
2
S
S
8
7
2
31a
5
5
31b
31
34
3

METHOD AND APPARATUS FOR PRODUCING HOLLOW METAL INGOTS

BACKGROUND OF THE INVENTION (1) Field of the Invention:

The present invention relates to a method and an apparatus for producing hollow metal ingots. More particularly, the invention relates to a method for casting materials, that is, hollow metal ingots (hereinafter, typical "steel ingots" will be discussed by way of example), used for the production of cylindrical forged steel articles such as pressure vessel materials, oversized ring materials and the like as well as an apparatus used for performing the above method.

(2) Related Art Statement:

Recently, uses of hollow steel ingots have been largely expanded, and with this expansion, demands for shapes and qualities of the hollow steel ingots required have become severer and diversified. For instance, there are demands for producing large size articles exceeding 300 tons and articles having no inverse V-shaped segregation lines in the inner surface thereof.

It is now not so difficult to produce such hollow steel ingots themselves. For instance, there are known the following producing techniques:

(1) By using a metallic cylinder as an outer tube to be brought into contact with a molten steel and employing a solid core or a core of a hollow metallic cylinder inside the outer tube, hollow steel ingots are produced while a cooling fluid such as air or steam is flown into the core (see British patent No. 52 05 98).

(2) A core consisting of a cylindrical steel pipe and a cylindrical refractory member formed contacting the inner wall of the cylindrical steel pipe is placed at the center of a mold positioned on a stool, and hollow steel ingots are produced by pouring a molten steel between the mold and the core (see Japanese patent application laid-open No. 54-117,326).

Since the above prior art techniques give easy formation of the core and good cooling performance of the core, it can be said that they are excellent techniques. However, since the demands have been recently not only getting severer and severer for the quality of hollow steel ingots but also the size of the steel ingots has become greater, it is an actual situation that such tendencies cannot be coped with by the prior art techniques. That is, with increase in the size of the steel ingots, it has become difficult to produce hollow metallic cylinders which can withstand the static pressure of the molten steel, be appropriately buckled and deformed and at the same time still maintain a necessary hollow shape against the succeeding pressure. Further, when the size of the steel ingots become larger, cooling of the steel ingots from the inside of the core becomes insufficient. As a result, inverse V-shaped segregation is liable to appear, so that there occurs a quality problem with respect to steel ingots such as materials for atomic energy generation plant for which severer quality is demanded.

For instance, when the thickness of the metallic cylinder itself forming the outer shell of the core is increased to cope with the oversizing of the steel ingots and demands for the quality thereof, the cooling power must be strengthened. On the other hand, fatal cracks occur in the inner surface of the steel ingots if buckling is not produced. If the thickness of the metallic cylinder of the core is reduced, cracking at the inner surface of the steel ingot can be avoided owing to an appropriate degree of buckling. However, there is a danger that the core is crushed because the buckling amount may be beyond the control. With respect to this, if the buckling of the core is intended to be suppressed midway, it is necessary to install an obstacle between the metallic cylinder and a cooling fluid supply system. Consequently, sufficient cooling cannot be performed.

Further, it is known to use water as a cooling fluid. Although in this case the cooling effect is improved, it makes the deformation of the metallic cylinder difficult and there remains a fatal problem in safety. Thus, this technique is not practical.

SUMMARY OF THE INVENTION

Under the circumstances, it is an object of the present invention to propose an advantageous technique for producing hollow metal ingots of a large size which do not develop cracks in the inner surface thereof and have excellent internal quality.

It is another object of the present invention to provide an advantageous technique for obtaining hollow metal ingots, which develops no cracks in the inner surface of the metal ingots during the production of the oversize hollow metal ingots, gives excellent internal surface quality of the ingots, and has high safety during the production.

As a countermeasure for solving the above problems possessed by the prior art, the present invention is based on a fundamental idea that hollow metal ingots are produced by the steps of installing, in a central portion of a mold, a cylindrical metallic core which is to be cooled by supplying a cooling fluid thereinto, pouring a molten metal into an annular casting space formed between the mold and the core, and solidifying it through cooling from the inside and outside thereof, and is characterized in that the core is cooled with a cooling fluid by uniformly blowing an inert gas directly to the inner surface of the core at a time of high temperatures in a melt-pouring stage while the cylindrical metallic core being allowed to be buckled, and then uniformly blowing air directly thereto at the time of low temperatures in a solidifying stage.

According to another aspect of the present invention, there is a provision of a process for producing metal ingots with use of a core, wherein the core is constituted by a metallic cylinder constituting the outermost portion, an inner cylindrical lattice-fashioned buckling-adjusting frame which is inserted into the metallic cylinder while a buckling allowable interference is left therebetween and cooling fluid-blowing nozzles installed in the center, and when the core is cooled by blowing the cooling fluid toward the metallic cylinder through the blowing nozzles, an inert gas is used at least during casting, and water or a mixed mist of water and a gas, principally water, is used to cool the core after the metallic cylinder is buckled.

According to still another aspect of the present invention, there is a provision of a hollow metal ingot-producing apparatus comprising a mold placed on a stool and a cylindrical core concentrically placed in the center of the mold to form an annular casting space therebetween, wherein the core is constituted by a metallic cylinder located at an outermost portion contacting a molten metal, a cylindrical lattice-fashioned buckling-adjusting frame which is positioned in the metallic cylinder and provides passages through which the cooling fluid is blown, and a cooling gas vessel which is positioned in the frame and is provided with a number of cooling fluid blowing nozzles facing the openings, and a pipe is connected to the cooling gas vessel for selectively introducing an inert gas or air thereinto.

The construction of the present invention is characterized by that of the core. That is, the present invention is to provide the method and the apparatus characterized in that the buckling-adjusting frame is provided to preliminarily form an appropriate buckling interference of the metallic cylinder, the cooling fluid-blowing nozzles are provided to face the openings of the buckling-adjusting frame to appropriately promote the cooling of the metallic cylinder, and the cooling fluid employed are selectively used as a high temperature cooling fluid and as a low temperature cooling fluid.

According to the present invention, since occurrence of cracks in the steel ingots is diminished and the influence of the inverse V-shaped segregation lines is minimized, the hollow metal ingots having high quality can be assuredly obtained.

These and other objects, features and advantages of the invention will be appreciated upon reading of the following description of the invention when taken in conjunction with the attached drawings, with the understanding that some modifications, variations and changes of the same could be made by the skilled person in the art to which the invention pertains without departing from the spirit of the invention or the scope of claims appended hereto.

BRIEF DESCRIPTION OF THE DRAWINGS

For a better understanding of the invention, reference is made to the attached drawings, wherein.

DETAILED DESCRIPTION OF THE INVENTION

According to the present invention, the hollow steel ingots are obtained principally by concentrically arranging the cylindrical metallic core, which is to be cooled by supplying a cooling fluid thereinto, at the center portion of a mold, pouring a molten steel in an annular casting space formed between the mold and the core, and solidifying the molten steel through cooling from the inside and the outside thereof.

Figure 1:
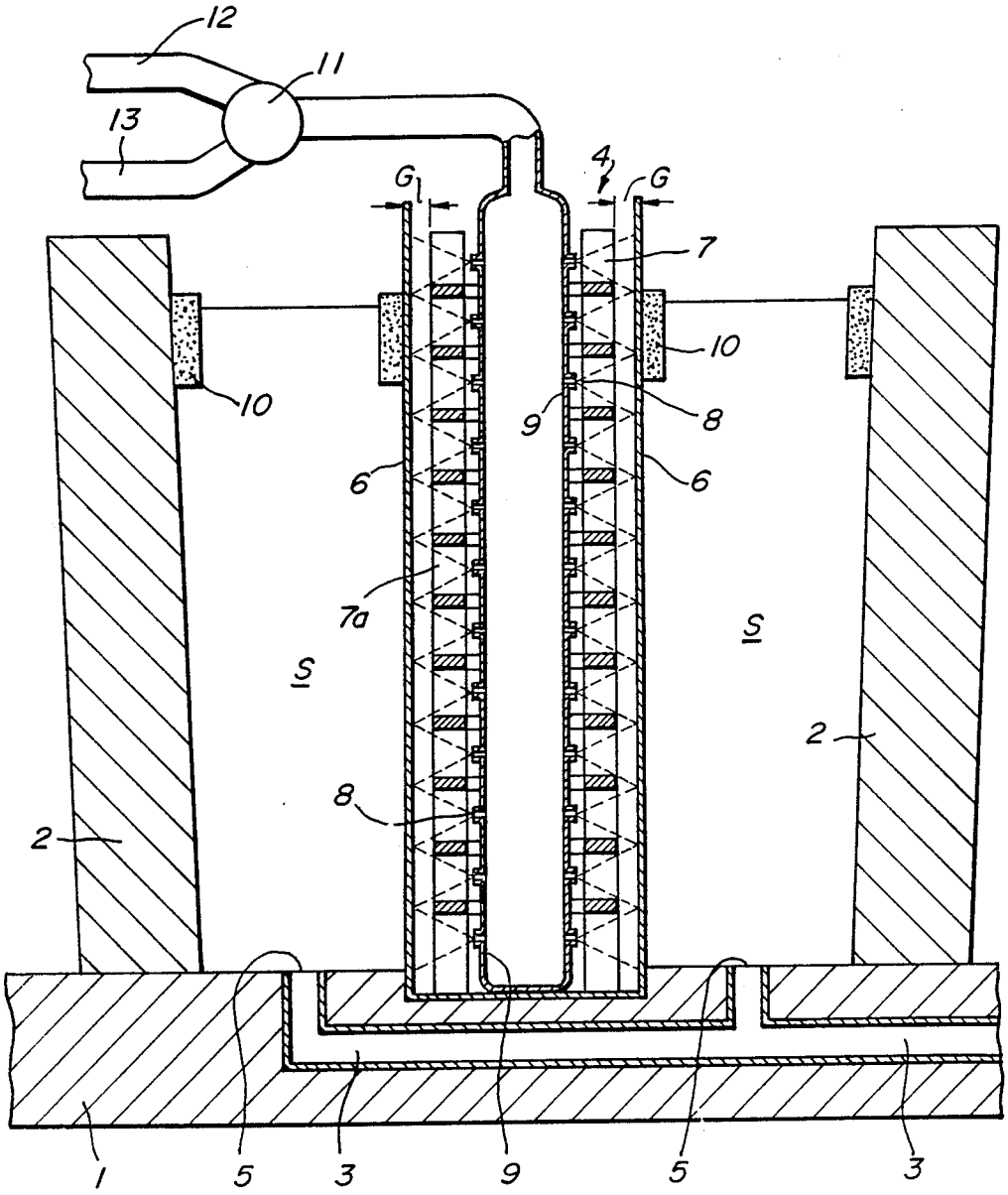
FIG. 1 is a sectional view of an embodiment of the hollow metal (steel) ingot-producing apparatus according to the present invention.

In such a method, as shown in FIG. 1, according to the present invention, the core 4 is constituted by a metallic cylinder 6 to be brought into contact with a molten steel in the casting space S, a cylindrical lattice-fashioned buckling-adjusting frame 7 having openings *7a* as cooling fluid passages, and a cooling gas vessel 9 having, at its periphery, a number of cooling fluid-blowing nozzles 8 which face the openings *7a*, and only a space G between the metallic cylinder 6 and the buckling-adjusting frame 7 is designed as a buckling interference of the metallic cylinder 6. The cooling fluid for cooling the metallic cylinder 6 is uniformly blown over the whole surface of the metallic cylinder from the fluid blowing nozzles 8 through the openings *7a* of the buckling-adjusting frame 7 having the lattice structure to uniformly cool the metallic cylinder. It is important to blow the cooling fluid such that a main portion of the cooling fluid may be impinged substantially vertically upon the metallic cylinder 6.

As the cooling fluid, an inert gas and air are used. According to the present invention, the inert gas is blown for 5 hours after the casting during which the metallic cylinder 6 is not less than 1,000° C., and then inexpensive air is blown. For this purpose, according to the present invention, an inert gas pipe line 12 and an air pipe line 13 are connected to a supply system for the cooling gas vessel 9 by way of a switching valve 11.

In summary, occurrence of cracks at the inner surface of the steel ingot is avoided due to the buckling of the metallic cylinder 6 by ensuring the buckling interference (gap G) between the metallic cylinder 6 and the buckling-adjusting frame 7. The buckling interference (gap G) is preferably from 5 to 40 mm. For, if it is less than 5 mm, the buckling amount is so small that cracks occur, while if it is more than 40 mm, the buckling amount becomes so large that the deformation of the solidified steel cannot follow the buckling thereby, causing cracks. Further, since the metallic cylinder 6 can be strongly cooled directly through the openings *7a* of the buckling-adjusting frame 7, the burn-out of the metallic cylinder 6 can not only be prevented, but also the internal quality of the steel ingot is enhanced to improve the quality of the articles. The reason why the blowing nozzles 8 are arranged facing the openings *7a* of the buckling-adjusting frame 7 to blow the main stream of the cooling fluid substantially perpendicularly to the metallic cylinder 6 is that the cooling effect may be further enhanced thereby. In addition, the reason why the buckling-adjusting frame 7 is designed in a lattice-fashioned structure is that the flowing of the cooling fluid may not be interrupted by the buckling-adjusting frame and that the force from the steel ingot may be endured after the metallic cylinder 6 is buckled.

Next, referring to the use of the cooling fluid, the reason why the inert gas is used at an initial stage and air is used at the latter stage is that a large heat capacity in the case of large size steel ingots may be coped with, and such is adopted because when the temperature of the metallic cylinder may reach 1000° C. or more, the metallic cylinder 6 may generate heat through oxidation with flown air to cause burn-out. In this respect, when the temperature reaches 1000° C. or less, the metallic cylinder 6 does not generate heat through oxidation even when air is blown thereto. Of course, air is inexpensive as compared with the use of the inert gas.

In the embodiment of FIG. 1, a reference numeral 1 is a stool having at least one up sprue 5 opened toward an annular casting space S inside a mold 2 and a runner 3. A reference numeral 10 is a heat insulating sleeve.

Figure 2:
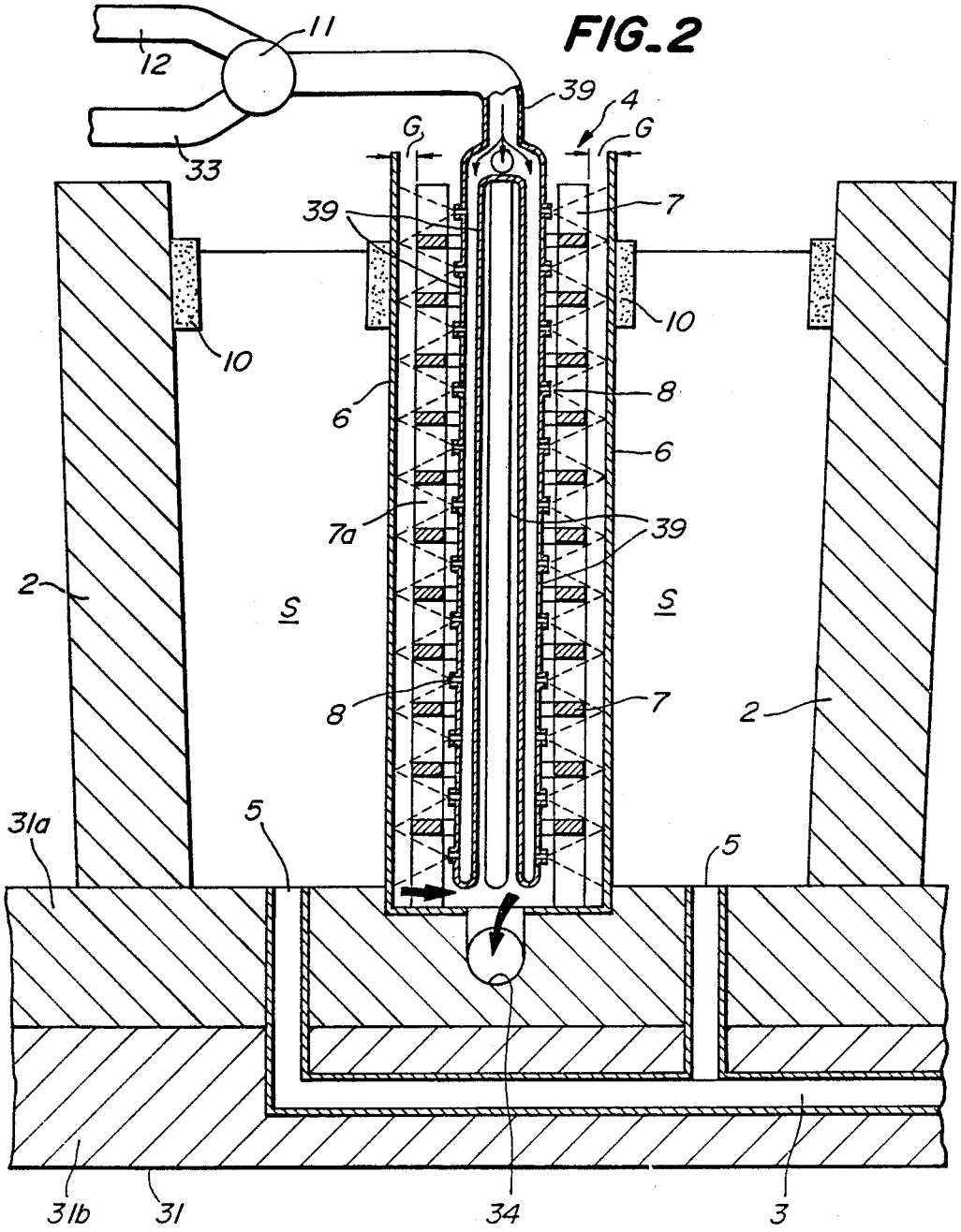
FIG. 2 is a sectional view of another embodiment of the hollow metal (steel) ingot-producing apparatus according to the present invention.

As shown in FIG. 2, according to the present invention, a core 4 is constituted by a metallic cylinder 6 (located at the outermost side) to be brought into contact with a molten steel in a casting space S, a cylindrical lattice-fashioned buckling-adjusting frame 7 having openings *7a* as cooling fluid passages, and a nozzle pipe 39 in which a number of cooling fluid-blowing nozzles 8 are arranged in a pipe axial direction facing the openings *7a*, and only a gap G between the metallic cylinder 6 and the buckling adjusting frame 7 is designed as a buckling-allowable interference. In order to cool the metallic cylinder 6, the cooling fluid of an inert gas, water or a mixed mist thereof (cooling fluid) is uniformly blown over the whole surface of the metallic cylinder 6 from the fluid blowing nozzles 8 through the openings 7*a* of the lattice-fashioned buckling-adjusting frame 7 to cool the metallic cylinder. In this case, it is important that a main portion of the cooling fluid is impinged substantially perpendicularly upon the metallic cylinder 6 to enhance the cooling effect.

As the cooling fluid, use may be made of the inert gas, water or a mixed mist thereof depending upon casting stages. In the present invention, the inert gas is blown through the nozzles 8 at least during the casting so that the metallic cylinder 6 may be appropriately deformed (buckled) and thereafter water or the mixed mist is used as the cooling fluid. By so doing, the metallic cylinder 6 is deformed during the casting or at an early stage after the casting to prevent cracking of the inner surface of the steel ingot. On the other hand, since water is used after the solidified shell fully grows on the opposite surfaces of the steel ingot, the invention is characterized by being free from a danger of steam explosion.

In order to selectively use the cooling fluids according to the present invention depending upon the casting stages, a plurality of the nozzle pipes 39 are connected to the gas pipe lien 12 and the air pipe line 13 through a switching valve 11, and the mixed mist is obtained by opening either one or both of them.

As mentioned in the above, the reason why the inert gas is used at least during the initial stage of the casting and then switched to water is that the metallic cylinder 6 is required to be deformed so as to prevent the cracking at the inner surface of the steel ingot. According to the inventors' researches, the cracks occur at the inner surface of the steel ingot when the solidifying molten steel cannot withstand its tightening action of the core as the solidified shell shrinks during the intial solidifying stage. Therefore, if the stress upon the solidified shell is removed, cracks can be dismissed.

In summary, it was acknowledged from many casting examples that the deformation period of the metallic cylinder 6 is mainly before the completion of the casting. Consequently, if the stress of the solidified shell is removed when the casting is completed, no cracks occur in the inner surface of the steel ingot, which has been already solidified, even by strongly cooling the inner side of the steel ingot. However, the growth of the solidified shell is incomplete during the casting and there is a danger of a steel leakage when the stress is developed in the core and the solidified shell during the strong cooling. Accordingly, in order to remove the stress due to the deformation of the core and ensure the safety, it is necessary to cool the molten steel with the inert gas at least during the casting.

Since the heat capacity is large in the case of the large size hollow steel ingots, the metallic cylinder 6 may reach temperatures of 1000° C. or more. Thus, the reason why the inert gas is used is that if air is blown at such temperatures, the metallic cylinder generates heat through oxidation, and burns out.

The inert gas and water are used as the cooling fluid. As their pipe lines, use may be preferably made of a construction in which their pipe lines are united together near the mold through a switch valve 11.

As another pipe line construction, pipe lines for an inert gas and water are separately provided. In such a case, inert gas and cooling water can be simultaneously flown, and their flow rates may be independently controllable. This has a merit that the pipe lines can be easily produced.

As another embodiment, a cooling inert gas pipe line 12 and a cooling water pipe line 33 are constituted by a concentric double wall pipe. In such a case, when either one of the cooling fluid flows, the pipe line itself is cooled. Thus, it has a merit that a trouble such as abrupt boiling can be avoided when the cooling fluid is switched.

The amount of buckling produced in the casting initial stage is controlled by a gap G between the metallic cylinder 6 and the buckling-adjusting frame 7. The gap G is preferably controlled in a range of 5 to 50 mm. If it is less than 5 mm, cracks occur due to a limited buckling amount, while if it is more than 50 mm, the buckling deformed amount is so large that the produced solidified shell may crack and there is a danger of steel leakage.

As the cooling fluid employed after the completion of the casting, water is mainly used. A water discharge opening 34 is formed in the central portion of the stool 1 for discharging used water. Thereby, cooling water blown upon the metallic cylinder 6 is rapidly discharged outside the mold. By so constructing, since there is no need to suck up and remove the used water by means of a pump or the like, safe casting can be performed. Further, if the runner 3 intersects the water discharge opening 34, there is a danger of explosion. Therefore, such must be avoided. For this purpose, the stool is constituted by two stage plates 31*a*, 31*b*, and it may be that a water discharge opening 34 is formed in the upper plate 31*a* and a runner 3 is formed in the lower plate 31*b*. FIG. 2 shows such an embodiment in which contact between water and the molten steel can be completely prevented by forming a water discharge opening in a side of the upper plate and connecting it to a water discharge pipe.

Figure 3:
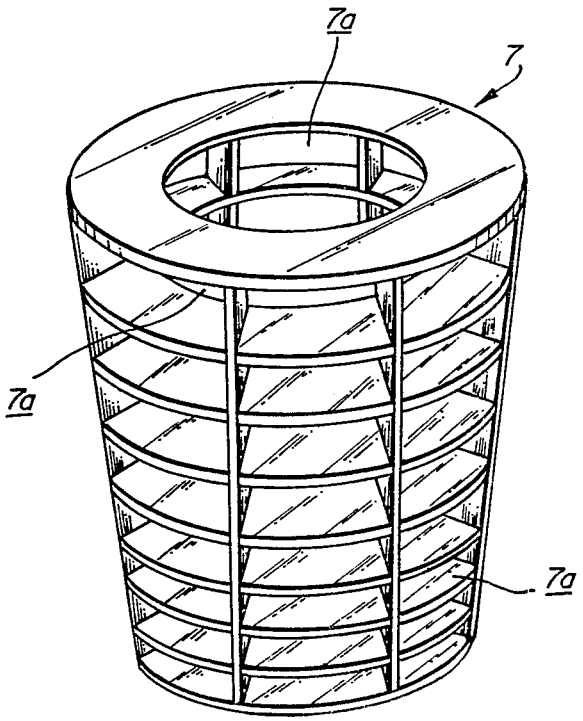
FIG. 3 is a perspective view of a buckling-adjusting frame.

FIG. 3 is a view showing a buckling adjusting frame 7 in detail.

By way of example, steel ingots were produced according to the method of the present invention by using the steel ingot-producing apparatus therefor.

EXAMPLE 1

A 200 ton hollow steel ingot having the average thickness of 1,150 mm was produced by bottom pouring. The composition of the poured steel was C:0.17 wt %, Si:0.23 wt %, Mn:1.43 wt %, Ni:0.80 wt %, Cr:0.14 wt %, Mo:0.53 wt %, and the balance being Fe, with impurity elements. A chrysanthemum-shape mold 2 was placed on a stool 1 having three up sprues 5, and a mild steel cylinder 6 having an outer diameter of 1,400 mm and an inner diameter of 1,360 mm, a buckling-adjusting frame 7 having an outer diameter of 1,320 mm and an inner diameter of 1,020 mm, and a cooling gas vessel 9 having an outer diameter of 980 mm and an inner diameter of 964 mm were placed in the center of the mold in this order from the outside to the inside thereof with a gap G being left at 20 mm. Starting from the beginning of the casting, nitrogen gas was flown through nozzles 8 at a flow rate of 100 $Nm^3$/min for 5 hours, and then switched to air at the same flow rate. The cooling gas was ejected toward the inner surface of the metallic cylinder 6 through the nozzles 8 attached at the side wall of the cooling gas vessel 9 in a direction orthogonal to the inner surface. The side wall of the cooling gas vessel 9 was provided with 350 nozzles having 6 mm in diameter.

Casting was carried out under the conditions that the melt rising rate was 145 mm/min while the molten steel temperature of 1,598° C. was maintained at an overheated degree of 85° C. The metallic cylinder 6 was adhered to the inner surface of the steel ingot, but no burn-out was observed. The maximum deformation was 20 mm. Then the steel ingot was forged and machined, but no crack occurred in the inner surface of the steel ingot during the forging. No undesirable portion as an end product appeared.

FIG. 2 is an embodiment of the producing apparatus for effecting the method according to the present invention. In the illustrated embodiment, a reference numeral 31 is a stool having one or more up sprues 5 opened toward an annular casting space S in the mold 2 and a runner 3. A reference numeral 4 is a core according to the present invention in which a metallic cylinder 6 and a buclking-adjusting frame 7 shown in FIG. 3 are concentrically assembled together and a nozzle tube 39 is positioned inside the buckling-adjusting frame 7 such that cooling fluid-blowing nozzles 8 arranged in the nozzle pipe 9 facing openings of the buckling adjusting frame 7. The cooling fluid-blowing nozzles 8 are attached to the nozzle pipe 39. A switching valve 11 is provided in an extension of the nozzle pipe 39 from the mold, which allows selective use of inert gas and water as the cooling fluid. In the illustrated embodiment, reference numerals 12 and 33 are pipe lines for inert gas and cooling water, respectively.

EXAMPLE 2

A 200 ton hollow steel ingot having the average thickness of 1,150 mm was cast by bottom pouring. The composition of the poured steel was C:0.21 wt %, Si:0.22 wt %, Mn:1.49 wt %, Ni:0.78 wt %, Cr:0.14 wt %, Mo:0.54 wt %, and the balance being Fe with impurity elements. A chrysanthemum-shape mold was placed on a stool having three up sprues, and a mild steel cylinder having an outer diameter of 1,400 mm and an inner diameter of 1,360 mm, a buckling-adjusting frame of an outer diameter of 1,320 mm and an inner diameter of 1,020 mm, and cooling nozzle pipe were placed in the central portion of the mold in this order from the outside to the inside thereof.

During the casting, nitrogen gas was blown at a flow rate of 40 $Nm^3$/min from the beginning of the casting. Nitrogen gas was used as a cooling medium for 30 minutes after the completion of the casting, and then switched to water to cool the metallic cylinder by blowing it in an orthogonal direction thereof. The molten steel (1,597° C.) as poured was maintained at an overheating temperature of 89° C., and cast at a melt rising rate of 150 mm/min.

Figure 4A:
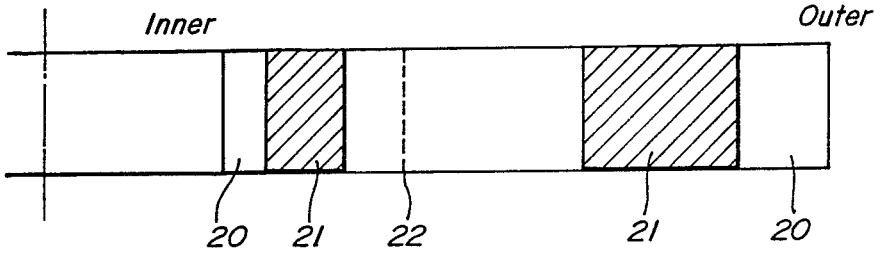
FIG. 4a PRIOR ART
FIG. 4 compares schematic views of macrostructures of (b) a hollow metal (steel) ingot obtained according to the present invention and (a) a hollow steel ingot obtained in the prior art just beneath a feeder head.
Figure 4B:
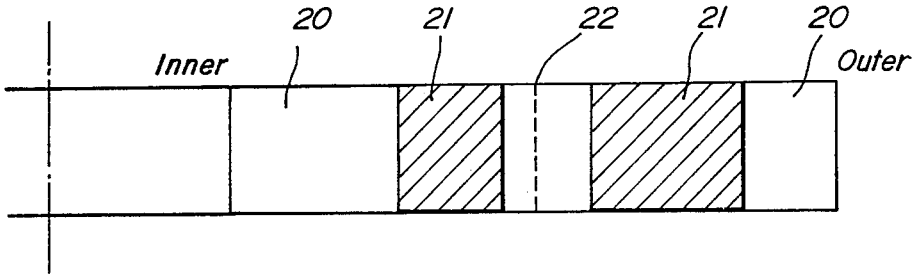

As a result, although the metallic cylinder was adhered to the inner surface of the steel ingot, no burn-out was observed. The maximum deformation was 20 mm. Then, the steel ingot was forged and machined, but no cracks occurred in the inner surface of the steel ingot during the forging and no undesirable portion was present as an end product. A sample was extracted from a product just beneath a feeder head to examine the macrostructure with respect to a sound portion 20, an inverse V-shaped segregation occurred portion 21 and a final solidified portion 22. Results shown in FIG. 4 were obtained. As compared with the conventional technique (FIG. 4(*a*)), the present invention (FIG. 4(*b*)) is obviously superior in that the inverse V-shaped segregation shifts inside.

As having been described in the aforegoing, according to the present invention, the cracking of the steel ingot can be prevented and influence upon the inverse V-shaped segregation line can be suppressed to minimum. Therefore, large size hollow steel ingots having high quality can be assuredly obtained. In particular, the effects of the present invention are remarkable with respect to the ring-shaped materials having a large diameter, and the ring products having excellent surface properties can be produced.

What is claimed is:

1. A process for producing hollow metal ingots, which comprises the steps of placing, in a central portion of a mold, a cylindrical metallic core which is to be cooled by supplying a cooling fluid thereinto, pouring a molten metal into an annular casting space formed between the mold and the core, and solidifying the thus poured molten metal through cooling from inside and outside thereof, wherein the cooling fluid is directly blown upon an inner surface of the core while the cylindrical metallic core is allowed to be buckled.

2. A process for producing hollow metal ingots, which comprises the steps of placing a cylindrical metallic core in a central portion of a mold and pouring a molten metal into an annular casting space formed between the mold and the core, wherein the core is constituted by an outermost metallic cylinder, a cylindrical lattice-fashioned buckling-adjusting frame inserted into the metallic cylinder while a buckling-allowble interference of the metallic cylinder is left therebetween, and cooling fluid blowing nozzles placed in a central portion of the buckling-adjusting frame, and when the core is to be cooled by blowing a cooling fluid toward the metallic cylinder through the blowing nozzles, an inert gas is used at least during casting, and after the metallic cylinder is buckled, cooling fluid selected from water and a mixed mist of water and a gas is used to cool the core.

3. An apparatus for producing hollow metal ingots, which comprises a mold placed on a stool, and a cylindrical core concentrically placed in a central portion of the mold to form an annular casting space therebetween, said core being constituted by an outermost metallic cylinder to be brought into contact with a molten metal, a cylindrical lattice-fashioned buckling-adjusting frame which is positioned in the metallic cyinder and gives openings as passages through which a cooling fluid is passed, and a cooling fluid vessel which is located in the buckling-adjusting frame and is provided with a number of cooling fluid-blowing nozzles.

* * * * *